US006886380B2

(12) United States Patent
Kato et al.

(10) Patent No.: US 6,886,380 B2
(45) Date of Patent: May 3, 2005

(54) LOCKING DEVICE, LOCKER, KEY AND LOCKING METHOD

(75) Inventors: Yoshihito Kato, Tokyo (JP); Masaharu Shirasawa, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 10/286,770

(22) Filed: Nov. 4, 2002

(65) Prior Publication Data

US 2003/0084691 A1 May 8, 2003

(30) Foreign Application Priority Data

Nov. 6, 2001 (JP) ..... P2001-341188

(51) Int. Cl.[7] ..... E05B 49/00
(52) U.S. Cl. ..... 70/278.3; 70/278.1
(58) Field of Search ..... 70/278.1, 278.3

(56) References Cited

U.S. PATENT DOCUMENTS 5,351,042 A * 9/1994 Aston ..... 340/5.61
5,469,727 A * 11/1995 Spahn et al. ..... 70/278.3
5,671,621 A * 9/1997 Watanuki et al. ..... 70/278.3
5,742,236 A * 4/1998 Cremers et al. ..... 340/5.26
5,826,450 A * 10/1998 Lerchner et al. ..... 70/278.3
6,005,487 A * 12/1999 Hyatt et al. ..... 340/5.65
6,155,089 A * 12/2000 Hurskainen et al. ..... 70/278.3
6,412,321 B1 * 7/2002 Aramburu et al. ..... 70/278.3

FOREIGN PATENT DOCUMENTS

| | | |
|---|---|---|
| AU | 199346299 A1 | 3/1994 |
| AU | 68000/96 | 4/1997 |
| AU | 28582/97 | 1/1998 |
| AU | 76283/98 | 7/1998 |
| AU | 199921309 B2 | 9/1999 |
| AU | 200071644 B2 | 11/2001 |
| JP | 9000720 A | 1/1997 |
| WO | WO 92//07157 A1 | 4/1992 |

* cited by examiner

*Primary Examiner*—John B. Walsh
(74) *Attorney, Agent, or Firm*—Sughrue Mion, PLLC

(57) ABSTRACT

A lock section is mechanically operated by a key provided with identification information to perform a locking or unlocking operation. A receiver acquires the identification information from the key. A checker determines whether the identification information acquired by the receiver matches with pre-stored registration information of the key. A limiter restricts the unlocking operation of the key when the checker determines that the identification information does not match with the registration information.

10 Claims, 11 Drawing Sheets

FIG. 7

| | | FIXED | | VARIABLE |
|---|---|---|---|---|
| | | HOUSE ID | INDIVIDUAL ID | AUTHENTICATION ID |
| 1 | KEY a | COMMON | UNIQUE TO KEY a | 0-9999 |
| 2 | KEY b | | UNIQUE TO KEY b | 0-9999 |
| 3 | KEY c | | UNIQUE TO KEY c | 0-9999 |
| 4 | KEY d | | UNIQUE TO KEY d | 0-9999 |
| 5 | KEY e | | UNIQUE TO KEY e | 0-9999 |

| | | | | | |
|---|---|---|---|---|---|
| 1 | KEY a | 253 | 124 | 5548 | |
| | | | | 23 | UPDATE |
| | | | | 4678 | UPDATE |
| | | | | 2299 | |
| | | | | 9888 | |
| | | | | 123 | |
| | | | | 5 | |
| | | | | 7812 | |

LOCKING DEVICE, LOCKER, KEY AND LOCKING METHOD

BACKGROUND OF THE INVENTION

The invention relates to a locking device, a locker and a key used in the locking device and a method for locking a door.

A mechanical locking device, such as that shown in FIG. 11, has hitherto been known. The locking device is provided at a door section for securing, for example, a door of a gaming machine to a main unit. As illustrated, the locking device has a fastener (i.e., a mechanical fastener) comprising a vertically-oriented base frame body 100. A hook member 101*a* is provided at an upper portion of the base frame body 100 so as to be rotatable about an axis 102*a*, and another hook member 101*b* is provided at a lower portion of the base frame body 100 so as to be rotatable about an axis 102*b*. A hook section 103*a* of the hook member 101*a* and a hook section 103*b* of the hook member 101*b* are latched onto an unillustrated fixture mounted on the main unit, thereby fastening the door to the main unit. In this way, in the mechanical fastener, the hook members 101*a*, 101*b* are joined together by coupling members 104*a*, 104*b* and operate in conjunction with each other. A device having vertically-stretchable coupling members and hook members attached to upper and lower portions of the coupling members is called a mechanical fastener, regardless of its shape.

A cylinder lock 105, which is a locker, is attached to a substantially center section of the base frame body 100 so as to move in conjunction with the coupling members 104*a*, 104*b*. The cylinder lock 105 is constituted of a cylinder which can be operated only when a matching key is inserted into the cylinder lock 105, and an adjuster which adjusts the overall length of the cylinder lock 105. A key matching the cylinder lock 105 is inserted into the cylinder lock 105 in the direction of arrow A shown in the drawing. When the key is turned in a clockwise or counterclockwise direction, the coupling sections 104*a*, 104*b* are slid upward (in the direction of arrow B in the drawing), thereby lifting an end section 106*a* of the hook member 101*a* and raising an end section 106*b* of the hook member 101*b*. As a result, the hook member 101*a* rotates about the axis 102*a* in the direction of arrow C in the drawing, and the hook member 101*b* rotates about the axis 102*b* in the same direction. The hook sections 103*a*, 103*b* are then released from the fixture provided on the unillustrated main unit. In the locking device, the key serves as a door knob (i.e., a handhold of the door). The key is turned in either the left or right direction, thereby releasing the hook sections 103*a*, 103*b* from the fixture. If the door is pulled in this state, the door is opened.

For a casino where a large number of gaming machines are installed, cylinder locks which have already been attached to gaming machines at the time of shipment from a factory are replaced with cylinder locks designed specifically for the casino (i.e., cylinder locks using so-called house keys), with a primary object toward ensuring security and obviating a necessity for employees to carry a large number of keys. Since the overall length of a cylinder varies from one gaming machine manufacturer to another manufacturer, a cylinder lock to be used is matched to gaming machines by a change in adjusters. As mentioned above, replacement of existing cylinder locks to cylinder locks using house keys enables use of locker specifically designed for each casino without regard to a gaming machine manufacturer.

Incidentally, an ID authentication locking device is described in, e.g., Japanese Patent Publication No. 9-720A.

In order to prevent unauthorized unlocking of a gaming machine, the locking device performs checking of an ID code through use of a transponder element. When the ID code is determined to be matched, an electric lock; e.g., a solenoid, is released. In this way, an attempt is made to improve safety by disabling opening of a gaming machine unless an ID code is determined to be matched.

A locker involving use of a lock and a key having a keyway and irregularities and a locking device constituted of a mechanical fastener can withstand great force used in an attempt to pry open a door, because of the mesh of members of high strength. However, copying of the physical geometry of a key enables easy occurrence of fraud.

Meanwhile, the above ID authentication locking device electrically releases a lock when an ID code is determined to be matched, thereby eliminating a problem stemming from copy of physical geometry of a key. However, a mere electrical lock cannot be said to provide sufficient strength. Specifically, a electrical lock, such as a solenoid, prevents release of a door by merely causing a metal pin to advance from a solenoid and does not involve the meshing of members having high strength as employed in a mechanical locking device. Therefore, use of only an electric lock results in insufficient resistance to great force used in an attempt to pry open a door. In a case where an ID authentication locking device having an electrical lock is combined with a fastener of high strength, the locking device becomes bulky and involves a cost hike. In the case of a locker using a key, the key also serves as a door knob. In contrast, an electrical-lock-type card key locker must be additionally provided with a knob.

SUMMARY OF THE INVENTION

It is therefore an object of the invention to provide a locking device and a locking method having the following features.

(1) In order to prevent occurrence of fraud, which could otherwise be caused by copying of a key, an ID authentication system is adopted. Further, from the viewpoint of strength, the invention ensures the same reliability as that achieved for a related-art mechanical locking device or higher reliability, thereby withstanding attempts at unauthorized access, such as prying of a door or a like activity.

(2) Circumstances where cylinder locks attached to gaming machine at the time of shipment are removed and replaced with house keys have been taken into consideration. Of a locking device, a mechanical fastener which may change in accordance with a structural difference existing in gaming machines is left as is. The other portion of the locking device is replaced with a locker having an additional ID authentication feature. A new security system can be embodied by a simple replacement operation while a related-art mechanical fastener of high strength reliability remains unchanged.

(3) With a view toward disseminating this new security system, the system can readily comply with gaming machines from various manufacturers without entailing a significant change in the conventional construction of the gaming machine.

(4) In terms of a sense of locking and unlocking operation, the system follows the conventional technology. In other words, an operator can operate a locker in the same manner as in the case of a related-art locking device without any special awareness of a new security system.

(5) The security system of the invention has a potential for development as a security system. In other words, a locker can flexibly cope with needs, such as a security system of stand-alone type which operates solely, or a security system of network type in which locking and unlocking operations are collectively managed by a server computer.

(6) Power can be supplied to a security system even when the system is isolated. Specifically, the system is imparted with an electrical authorizing function and hence requires power supply. Even when no power is supplied to a main unit to be locked (e.g., a gaming machine), the system must be operable at all times. For this reason, the system is equipped with a rechargeable battery. When power is supplied to the main unit, the system operates while the battery thereof is being recharged. When power supply has been cut, the system operates with a battery.

In order to attain the above features, according to the present invention, there is provided a locking device operable with a key provided with identification information, the locking device comprising:

a lock section, mechanically actuated by the key to perform a locking or unlocking operation;

a receiver, which acquires the identification information from the key;

a checker, which determines whether the identification information acquired by the receiver matches with prestored registration information of the key; and a limiter, which restricts the unlocking actuation of the lock section when the checker determines that the identification information does not match with the registration information.

In this device, when acquired identification information does not match the registered information, unlocking actuation is restricted, thereby eliminating a chance of occurrence of unauthorized unlocking operation, which could otherwise be caused by copying of a key. Further, the identification information acquired from the key is checked against previously-registered identification information. Only when identification information matches the registered information, unlocking actuation is enabled, thereby rendering unauthorized unlocking operation more difficult. In addition to the above locking device, use of a mechanical fastener enables sufficient resistance to prying of a door, thus improving security.

Preferably, the lock section is formed with a hole. The limiter has a protrusion movable between a first position which is inside of the hole and a second position which is outside of the hole. The protrusion is placed at the first position when the checker determines that the identification information does not match with the registration information.

In such a configuration, a structure used for restricting actuation of the lock section is simplified, thereby curtailing costs. Moreover, if the identification information does not match the registered information, the projection is still inserted in the hole, thereby eliminating a chance of occurrence of unauthorized unlocking operation.

Preferably, the locking device further comprises an adjuster connected to the lock section to adjust an entire size of the locking device in accordance with a size of the key, the adjuster accommodates the limiter therein.

In such a configuration, since the checker is provided in the adjuster, an attempt can be made to make the configuration compact and facilitate an operation for installing the locking device.

Preferably, the locking device further comprises an actuator interlocked with the locking or unlocking operation of the lock section. The limiter has a protrusion movable between a first position which disable the actuator to move and a second position which enable the actuator to move. The protrusion is placed at the first position when the checker determines that the identification information does not match with the registration information.

In such a configuration, a structure used for restricting actuation of the lock section is simplified, thereby curtailing costs. Moreover, if the identification information does not match the registered information, the projection still disables the actuation of the key, thereby eliminating a chance of occurrence of unauthorized unlocking operation.

Alternatively, the locking device further comprises an actuator interlocked with the locking or unlocking operation of the lock section. The actuator is formed with a hole. The limiter has a protrusion movable between a first position which is inside of the hole and a second position which is outside of the hole. The protrusion is placed at the first position when the checker determines that the identification information does not match with the registration information.

In such a configuration, a structure used for restricting actuation of the lock section is simplified, thereby curtailing costs. Moreover, if the identification information does not match the registered information, the projection is still inserted into the hole, thereby eliminating a chance of occurrence of unauthorized unlocking operation.

Preferably, the receiver includes an antenna which performs radio wave communication. The lock section includes a guide member which guides a wiring line for the antenna.

In such a configuration, a radio communication function can be imparted to the lock section. Further, the antenna and the lock section can be integrated together. Consequently, identification information or like information can be transmitted and received by merely replacing an existing locking device with the locking device of the invention.

Here, it is preferable that the identification information is communicated via the radio wave communication.

In such a configuration, a radio communication function can be imparted to the key. As a result, identification information or like information can be transmitted and received by radio communication.

Preferably, the locking device further comprises a storage, which stores unlocked information when the restriction of the unlocking actuation of the limiter is released.

In such a configuration, a history of unlocked operation can be saved. Hence, the use condition of the key can be ascertained, thereby facilitating identification of the person who has used the key. Thus, security is improved.

According to the present invention, there is also provided a locking security system, comprising:

a key, including a first storage which stores identification information;

a network;

a manager, connected to the network;

at least one terminal, connected to the manager via the network, the terminal provided with a door;

a lock section, provided in the terminal and actuated by the key to lock or unlock the door;

a receiver, provided in the terminal to acquire the identification information from the key;

a second storage, provided in the terminal to store registration information of the key;

a checker, which determines whether the identification information acquired by the receiver matches with the registration information; and a limiter, which restricts an unlocking actuation of the key when the checker determines that the identification information does not match with the registration information.

Here, the checker may be provided in the terminal, or in the manager, or on the network between the terminal and the manager.

Preferably, the key includes a first communicator and the receiver includes a second communicator so that information including the identification information is communicated.

Here, it is preferable that radio wave communication is performed between the first communicator and the second communicator.

Preferably, the manager includes a third storage a storage which stores unlocked information when the restriction of the unlocking actuation of the limiter is released.

In this system, in addition to the above-mentioned advantages, since identification information about the key can be checked against the registered information by way of the network, locking operation and unlocking operation can be controlled in a centralized manner.

Preferably, the manager includes a writer which rewritably records the identification information in the first storage.

Here, it is preferable that the writer updates the identification information when the restriction of the unlocking actuation of the limiter is released.

In such a configuration, the latest identification information can be used at all times. Specifically, the identification information to be used for identifying the key is rewritten to the latest information at all times. Hence, even if information has been acquired before rewriting, unauthorized unlocking operation becomes considerably difficult.

In order to attain the same advantages, according to the present invention, there is also provided a method of locking a door, comprising the steps of:

providing a key with identification information; providing a locking device which locks or unlocks the door;

storing registration information of the key in the locking device;

restricting an unlocking actuation of the locking device;

inserting the key into the locking device;

comparing the identification information and the registration information; and releasing the restriction of the unlocking actuation of the locking device so as to be actuatable with the key, when the identification information and the registration information are matched.

Preferably, the locking method further comprises the step of storing unlocked information when the releasing step is performed.

Preferably, the locking method further comprises the step of updating the identification information when the releasing step is performed.

As mentioned above, a history of key operation is saved. Hence, the user condition of a key can be ascertained, and specifying a person who has used the key becomes easier. Hence, security can be improved.

According to the present invention, there is also provided a key, to be inserted into a locking device which locks or unlocks a door, the key comprising:

a storage, which stores identification information; and a communicator, which transmits the identification information to the locking device, wherein the key serves as a knob member of the door when the key is inserted into the locking device.

This key itself becomes a door knob when inserted into the locking device, thereby eliminating a necessity for providing a door with a door knob.

BRIEF DESCRIPTION OF THE DRAWINGS

The above objects and advantages of the present invention will become more apparent by describing in detail preferred exemplary embodiments thereof with reference to the accompanying drawings, wherein:

FIG. 7 is a view showing an example configuration of an ID code;

DETAILED DESCRIPTION OF THE PREFERRED EMBODIMENTS

Figure 1:
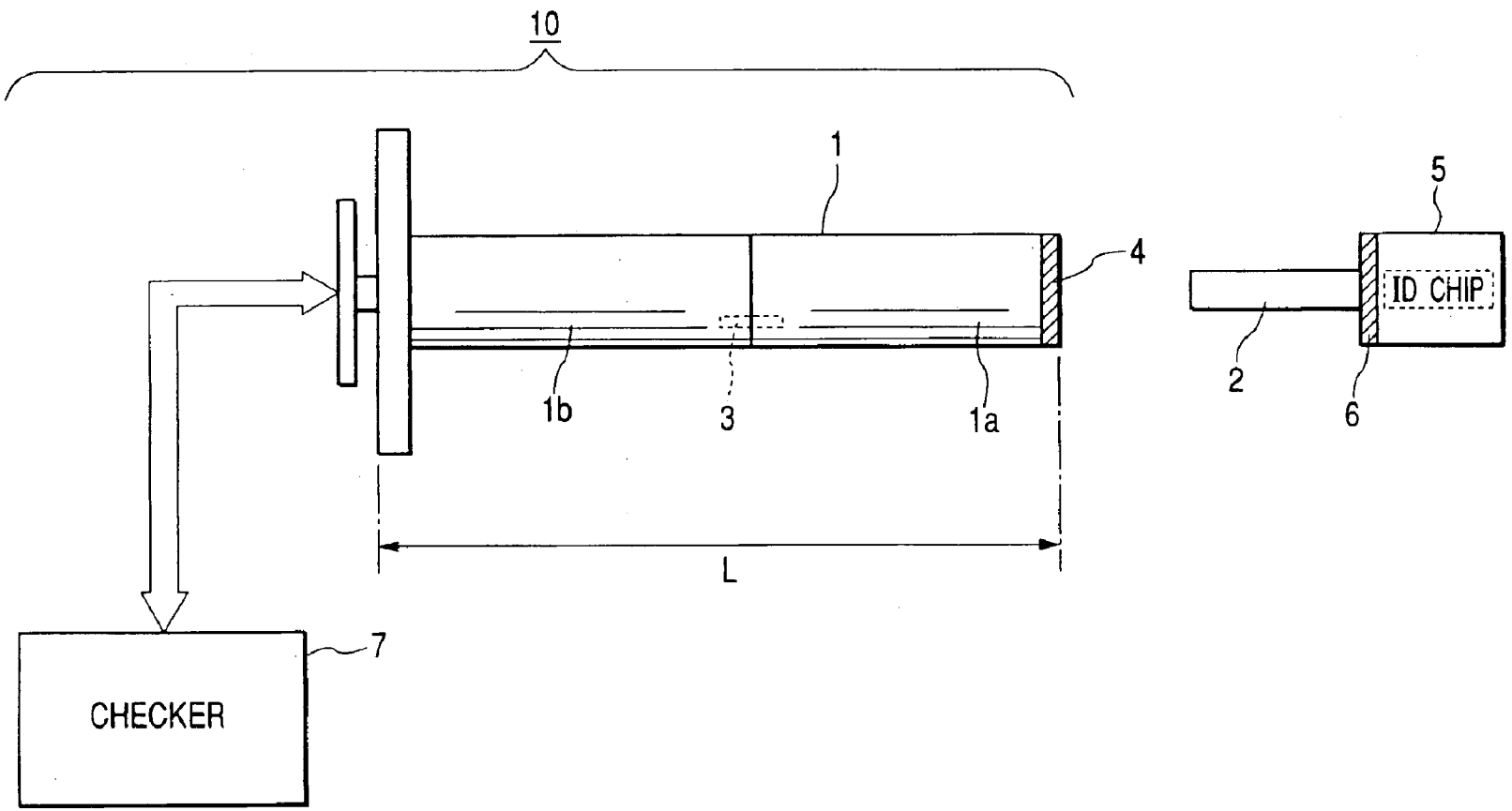
FIG. 1 is a view schematically showing a configuration of a locker according to a first embodiment of the invention.

Preferred embodiments of the invention will be described hereinbelow. FIG. 1 schematically shows the configuration of a locker according to a first embodiment of the invention. The locker is constituted of a cylinder lock unit 10. Within the cylinder lock unit 10, a key section 1 comprises a cylinder 1*a* which enables an unlocking or locking operation only when a compatible key 2 is inserted into an unillustrated keyway; and an adjuster 1*b* for adjusting a length L provided in the drawing. A limiter 3 to be used for restricting operation of the key 2 is provided in the key section 1. Even when the key 2 is compatible with the cylinder 1*a*, neither a locking operation or an unlocking operation can be performed with the key 2 unless the limiter 3 lifts restrictions. As will be described later, the limiter 3 can be constituted of, e.g., a projection which can advance or recede. In the first embodiment, the limiter 3 is incorporated into the adjuster 1*b* but may be attached externally to the lock section 1. A receiver 4 is provided on the right end of the cylinder 1*a* shown in the drawing, for acquiring identification information about the key 2. The receiver 4 can be constituted of an antenna which receives identification information as a radio signal. The receiver 4 can also assume another construction. For example, the receiver 4 can also be constituted of, e.g., an interface for an infrared-ray light-receiving section or cable connection. The identification information about the key 2 acquired by the receiver 4 is transferred to a checker 7.

The key 2 has a storage 5 for storing identification information. The storage 5 can be constituted of an ID chip serving as a RAM which enables reading and writing of data. The key 2 has a communicator 6 which communicates identification information by a radio signal. The communicator 6 can be constituted of a compact antenna. Alternatively, the communicator 6 can be constituted of an interface for an infrared-ray light-emitting section or cable connection. In the first embodiment, the identification information retained by the storage 5 is transmitted from the communicator 6 by wireless communication. When the communicator 6 has received new identification information by wireless communication, the information is stored in the storage 5. The storage 5 and the communicator 6 may be provided integrally with or separately from the key 2. When the storage 5 and the communicator 6 are provided integrally with the key 2, there may be adopted a construction in which the storage 5 and the communicator 6 are incorporated into the key 2. When the storage 5 and the communicator 6 are provided separately from the key 2, there may be adopted a construction in which a tag having the storage 5 and the communicator 6 mounted thereon is added to the key 2.

The checker 7 serves as an unlock controller. More specifically, the checker 7 is constituted of a CPU, a ROM, and a RAM. The checker 7 checks the identification information acquired by the receiver 4 against previously-registered registration information. So long as a result of check shows that the identification information matches the registration information, the checker 7 outputs a signal indicating that a restriction on the limiter 3 should be released. Only when having received a signal indicating that a restriction on the limiter 3 should be released, the limiter 3 cancels the restriction. An unlocking or locking operation can be performed with the key 2 only after the limiter 3 has released the restriction.

The key 2 has a keyway and irregularities. The cylinder 1*a* may be a general locking device which becomes rotatable only when the geometry of the key 2 matches that of the keyway. Alternatively, the key 2 may be a key assuming the shape of a simple rod in which a keyway or irregularities are not formed. In this case, the cylinder 1*a* may also be made in a simple structure having a mechanism of effecting rotation only when the restriction 3 has released a restriction. In this case, the storage 5 and the communicator 6 may be provided in a rod-shaped portion of the key.

Figure 2:
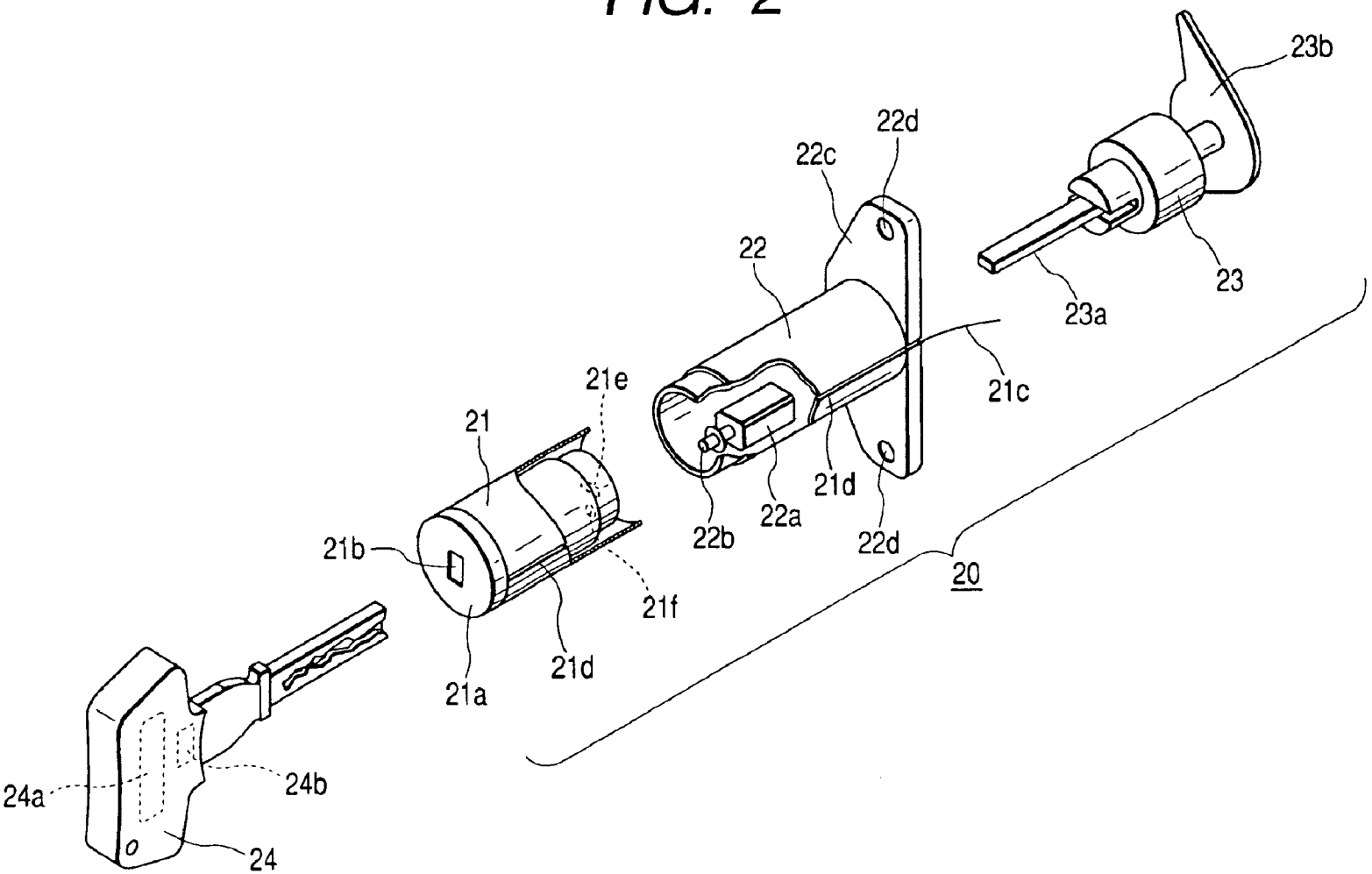
FIG. 2 is a view showing a mechanical configuration of a cylinder unit of the first embodiment.

A specific construction of the cylinder lock unit will now be described. As shown in FIG. 2, a cylinder lock unit 20 is constituted of a cylinder 21 serving as a lock section, an adjuster 22, and an actuator 23.

Only when a compatible key 24 has been inserted into a keyseat 21*b*, the cylinder 21 enables mechanical locking or unlocking operation. An antenna section 21*a* is provided at the end of the cylinder 21 facing the key 24. The antenna section 21*a* receives identification information transmitted from the key 24 and transmits new identification information to the key 24. The antenna section 21*a* is formed by molding a coiled wire with resin. In order to enhance a communication characteristic of the antenna section 21*a*, the antenna section 21*a* is isolated from a metal portion of the cylinder 21. The keyseat 21*b* to be used for insertion of the key 24 is provided in the vicinity of the center of the antenna section 21*a*. Grooves 21*d* to be used for guiding antenna lines 21*c* led from the antenna section 21*a* are formed in the cylinder 21 and the adjuster 22.

As a result, the cylinder lock unit 20 can be imparted with a radio communication function. The antenna lines 21*c* are guided by the grooves 21*d*, and hence the antenna section 21*a* and the cylinder lock unit 20 can be assembled into one piece. As a result, by replacing the existing cylinder lock with the cylinder lock unit 20 of the first embodiment, the lock apparatus can communicate identification information by wireless communication.

A joint hole 21*e* to be joined to a joint shaft 23*a* of the actuator 23 is provided at the end of the cylinder 21 facing the adjuster 22. As a result of the joint shaft 23*a* being joined to the joint hole 21*e*, the cylinder 21 and the actuator 23 operate in conjunction with each other, thereby enabling transmission of action of the key 24 to an unillustrated fastener disposed in a subsequent stage. A hole 21*f* to be joined to a projection 22*b* of a solenoid 22*a* provided in the adjuster 22 is provided on the end of the cylinder 21 facing the adjuster 22. As a result of the projection 22*b* being joined to the hole 21*f*, the cylinder 21 is fixed. Hence, even when the compatible key 24 is inserted into the keyseat 21*b*, a restriction is imposed on an unlocking operation and a locking operation.

In the solenoid 22*a*, the projection 22*b* is forced toward the cylinder 21 at all times. Since the projection 22*b* remains projecting in a standby state, the projection 22*b* is engaged with the hole 21*f*. However, when the solenoid 22*a* has received a signal indicating that a restriction should be released, the projection 22*b* recedes toward the actuator 23. As a result, the projection 22*b* is disengaged from the hole 21*f*, and the cylinder 21 can be rotated within a plane perpendicular to the direction of insertion of the key 24. Consequently, an unlocking or locking operation can be performed by use of the key 24.

As mentioned above, the projection 22*b* that can advance and recede is engaged with the hole 21*f*. Only when identification information matches registration information, the projection 22*b* is receded. As a result, a structure for restricting the operation of the key 24 is simplified, thereby enabling cost reduction. If identification information does not match the registration information, the projection 22*b* does not recede, thereby eliminating unauthorized unlocking action. Further, the solenoid 22*a* is incorporated into the adjuster 22, and hence the cylinder lock unit 20 can be made compact, thereby facilitating an installing operation.

A flange 22*c* is provided on the adjuster 22, and the locker 20 is fastened to, e.g., a gaming machine main unit, by way of fixture holes 22*d* provided in the flange 22*c* and by screws or other fasteners.

When the cylinder 21 is rotated as a result of the restriction being released and by an operation of the key 24, the joint shaft 23*a* rotates in association with rotation of the cylinder 21. As a result, the actuator 23 also rotates in the same direction, and a contact plate 23*b* provided in the actuator 23 transmits rotating force to an unillustrated fastener disposed in a subsequent stage.

The key 24 contains an ID chip 24*a* and a compact antenna 24*b*. The key 24 transmits identification information to the antenna section 21*a* by radio communication, and the antenna section 21*a* receives new identification information transmitted from the antenna section 21*a* by radio communication. As a result, the key 24 can be imparted with a radio communication function.

Figure 3:
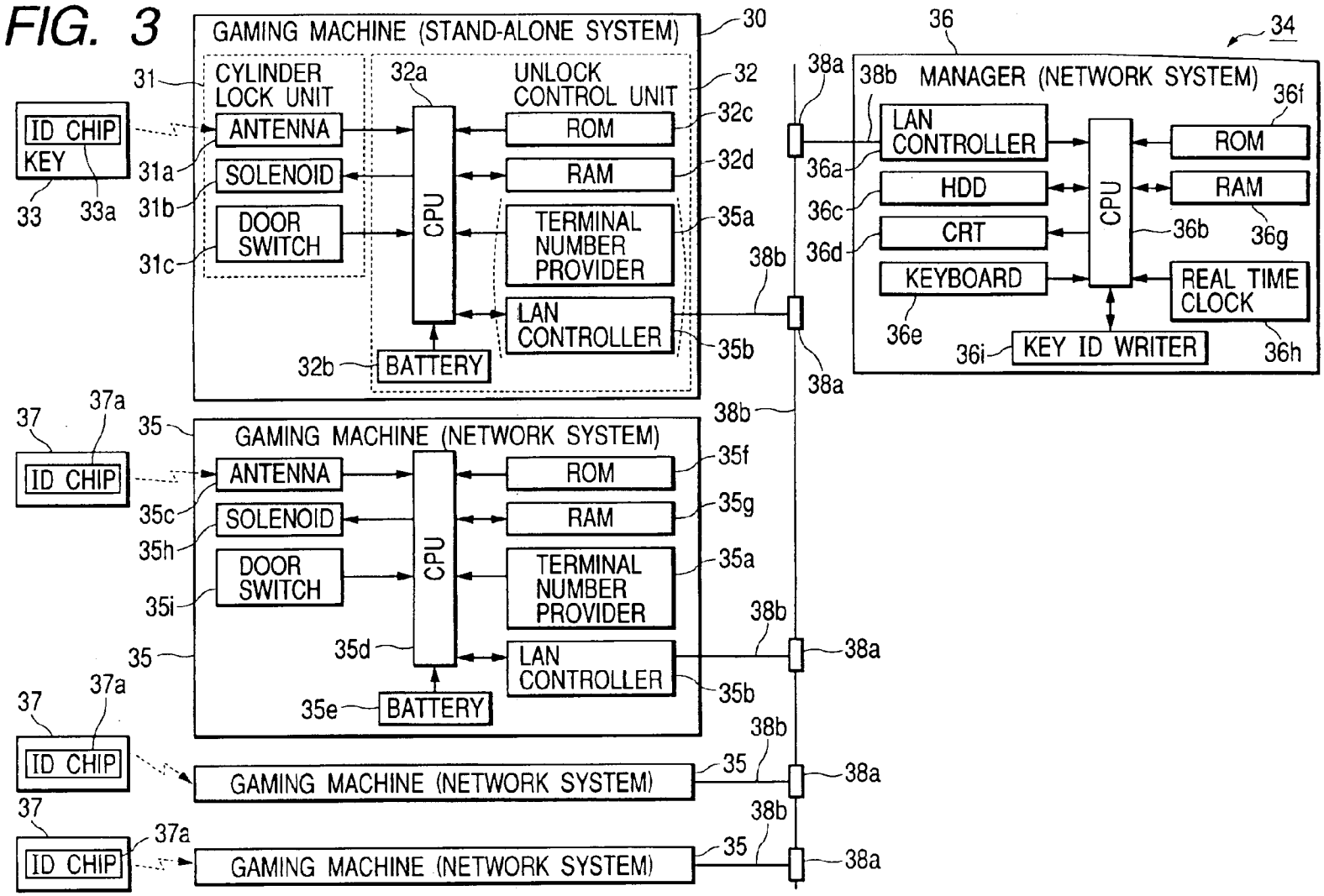
FIG. 3 is a view showing an electrical configuration of a gaming machine when the locker of the first embodiment is applied to the gaming machine.

FIG. 3 is a diagram showing an electrical configuration of a gaming machine when the locker of the first embodiment is applied to the gaming machine. The gaming machine manages locking and unlocking operations by a stand-alone system 30. The standalone system 30 is constituted of a cylinder lock unit 31, an unlock control unit 32, and a key 33. When the key 33 is mechanically inserted into the stand-alone system 30, an ID code which is stored in an ID chip 33*a* of the key 33 and serves as an identification number is transmitted by radio communication. By way of an antenna section 31*a*, the cylinder lock unit 31 receives the ID code transmitted from the key 33. The thus-received ID code is output to the unlock control unit 32. In the unlock control unit 32, a CPU 32*a* receives power supply from a battery 32*b* and loads a program from a ROM 32*c*, thus operating. Here, the battery 32*b* may be incorporated into the stand-alone system 30 or provided externally.

The CPU 32*a* checks the thus-received ID code against an ID code registered as registration information in a RAM 32*d* (or the ROM 32*c*). If a result of check shows that a match exists between the two ID codes, the CPU 32*a* activates a solenoid 31*b* provided in the cylinder lock unit 31. Specifically, a restriction imposed on actuation of the key 33 is released. More specifically, a voltage is applied to a solenoid 31*b*, thereby causing the projection (22*b*) to recede. As a result, an unlocking operation or locking operation can be performed with the key 33.

In order to enable the stand-along system 30 to detect opening of the gaming machine, the cylinder lock unit 31 is provided with a door switch 31*c*. Even when actuation of the key 33 is restricted by the solenoid 31*b*, if a door has been subjected to destruction or prying action, control of unlocking and locking operation cannot be performed properly. Even in such a case, the door switch 31*c* is provided for enabling detection of opening of a door.

A network system 34 is constituted of a terminal gaming machine 35, a manager 36, and a key 37. The terminal gaming machine 35 and the manager 36 are connected together by way of a communication port 38*a* and a communication cable 38*b*. In the terminal gaming machine 35, a terminal number provider 35*a* sets a terminal number, and a LAN controller 35*b* serves as a communication interface. In other respects, the terminal gaming machine 35 has a configuration analogous to that of the stand-alone system 30.

In the manager 36, the LAN controller 36*a* serves as a communication interface. The LAN controller 36*a* outputs received information to a CPU 36*b* and transmits information output from the CPU 36*b* to a destination device. The CPU 36*b* is connected to a hard disk drive 36*c* serving as an external storage device; a CRT 36*d* serving as a display device; and a keyboard 36*e*. The CPU 36*b* reads a program recorded in a ROM 36*f* and operates through use of a RAM 36*g*. A real time clock 36*h* represents a clock IC. When an unlock history to be described later is saved, the clock IC is referred to in order to save an operation time.

The manager 36 is provided with a key ID writer 36*i* which generates an ID code serving as identification information and which rewrites an ID of a key. The key ID writer 36*i* rewrites an ID code stored in an ID chip 37*a* of the key 37. A new ID code which is stored in the key 37 and has been rewritten is also stored in RAM 36*g* as registration information.

As mentioned above, an ID code serving as identification information and registration information is generated, and the thus-generated information is written into an ID chip and a RAM. Hence, the latest ID code can be used. Specifically, the ID code stored in the key and the ID code previously registered in the RAM are rewritten into the latest information. Hence, even if an ID code has been acquired before being rewritten, unauthorized unlocking becomes extremely difficult.

When the key 37 is mechanically inserted into the terminal gaming machine 35, an ID code which is stored in the ID chip 37*a* of the key 37 and serves as an identification number is transmitted by radio transmission. The ID code transmitted from the key 37 is received by the antenna section 35*a*, and the thus-received ID code is output to the CPU 35*d*. The CPU 35*d* receives power supply from a battery 35*e* and loads a program from a ROM 35*f*, thereby operating through use of a RAM 35*g*. Here, the battery 35*e* may be incorporated into the terminal gaming machine 35 or disposed externally.

The CPU 35*d* transmits a received ID code to the manager 36 by way of the LAN controller 35*b*. The CPU 36*b* of the manager 36 checks an ID code received from the terminal gaming machine 35 against an ID code which has been registered in the RAM 36*g* and serves as registration information. If a result of check shows that a match exists between the two ID codes, the CPU 36*b* sends, by way of the LAN controller 36*a*, a signal indicating that a restriction imposed by a solenoid 35*h* in the terminal gaming machine 35 should be released. The terminal gaming machine 35 applies a voltage to the solenoid 35*h*, thereby causing the projection (22*b*) to recede. As a result, an unlocking or locking operation can be performed with the key 36. The terminal gaming machine 35 is provided with a door switch 35*i* for detecting opening of a door of a gaming machine, as in the case of the stand-alone system 30.

Figure 4:
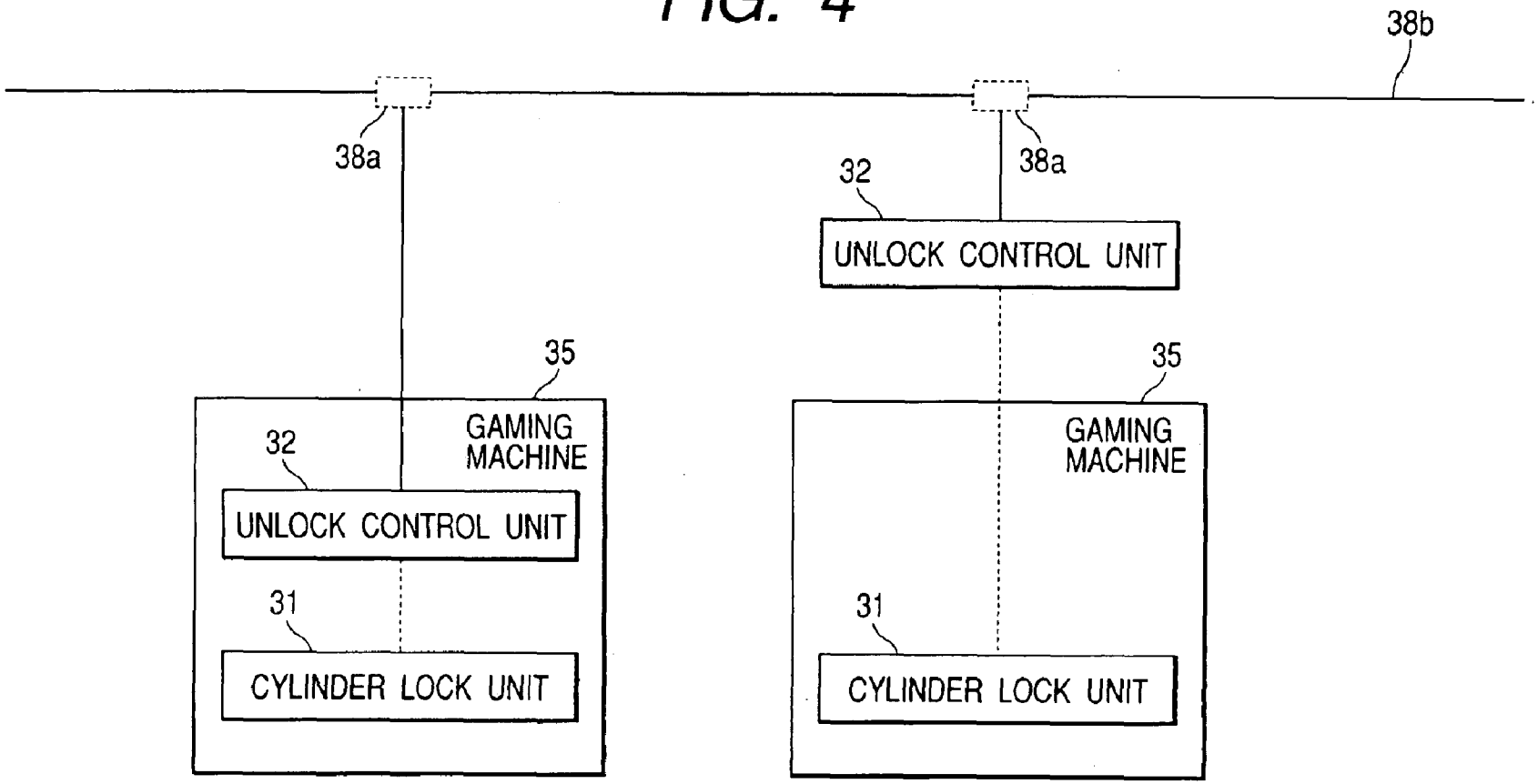
FIG. 4 is a view showing a mode of provision of an unlocking control unit.

The stand-alone system 30 is provided with the terminal number provider 35*a* and the LAN controller 35*b*. Hence, the stand-along system 30 can serve as a terminal device of the network system 34. As a result, the stand-alone system 30 operating alone can perform centralized control of unlocking and locking operations on the network as a network-compatible system. As shown in FIG. 4, the unlock control unit 32 may be incorporated into the gaming machine or disposed outside thereof.

Figure 5:
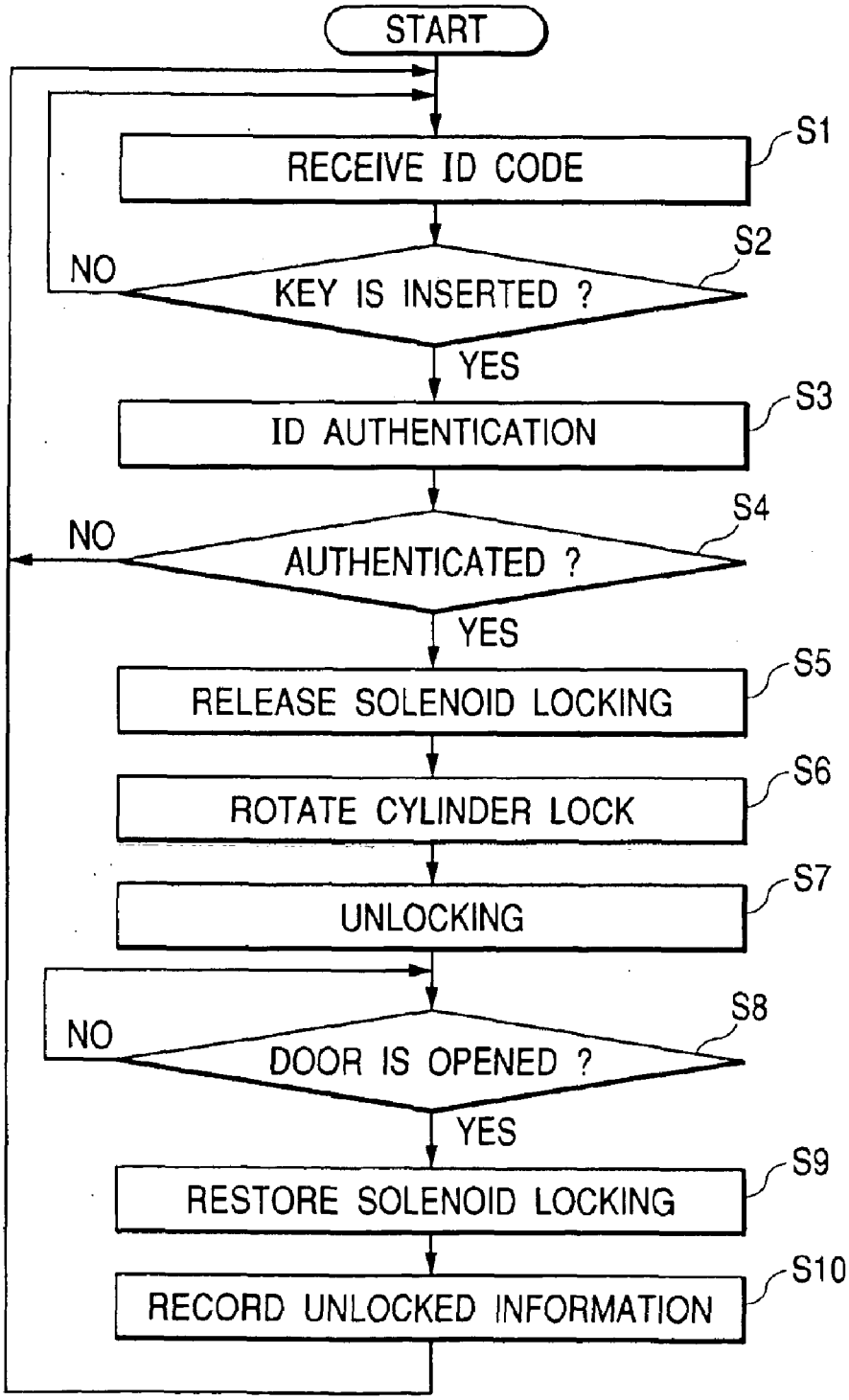
FIG. 5 is a flowchart showing unlocking operation of a stand-alone system.

By reference to a flowchart shown in FIG. 5, unlocking operation of the stand-alone system will now be described. In the stand-alone system 30, the antenna section 31*a* remains in a standby condition while remaining ready to receive at all times. Upon receipt of the ID code transmitted from the key by radio communication by way of the antenna section 31*a* (step S1), the stand-alone system 30 determines whether or not the key is inserted (step S2). If a key is not inserted, the determination to be performed in step S2 is iterated. When the key is inserted, ID authentication is performed (step S3). If a result of ID authentication (step S4) shows that the ID code is not authenticated, processing returns to step S1. In contrast, if the ID code is authenticated, the solenoid is released (step S5). As a result, actuation of the inserted key becomes possible. When a key is turned (step S6), a locker provided on the gaming machine is unlocked (step S7). Next, a determination is made as to whether or not the door of the gaming machine has been opened (step S8). If the door has not been opened, the determination to be performed in step S8 is iterated. In contrast, if the door can has been opened, the solenoid is restored to its original position (step S9). Finally, an unlock history is saved (step S10), whereby processing is terminated.

As mentioned above, even when a specific key is inserted into the stand-alone system, actuation of the key is restricted if an ID code acquired from the key does not match a registered ID code, thereby eliminating unauthorized unlocking action, which could otherwise be caused by copying of a key. The ID code acquired from the key is checked against the previously-registered ID code. When a match exists between the ID codes, actuation of the key is allowed, thereby making unauthorized unlocking action more difficult. Use of the locker of the invention for a mechanical fastener enables sufficient resistance to prying of a door, thereby improving security. Further, the cylinder 21 serves as a door knob as in the case of the related-art cylinder. Hence, there is obviated a necessity of adding a door knob to the cylinder 21. Moreover, replacement of an existing cylinder lock unit with the cylinder lock unit of the first embodiment is easy. Moreover, the cylinder lock unit of the invention can be readily applied to gaming machines of various types. Hence, the system can be disseminated widely.

Figure 6:
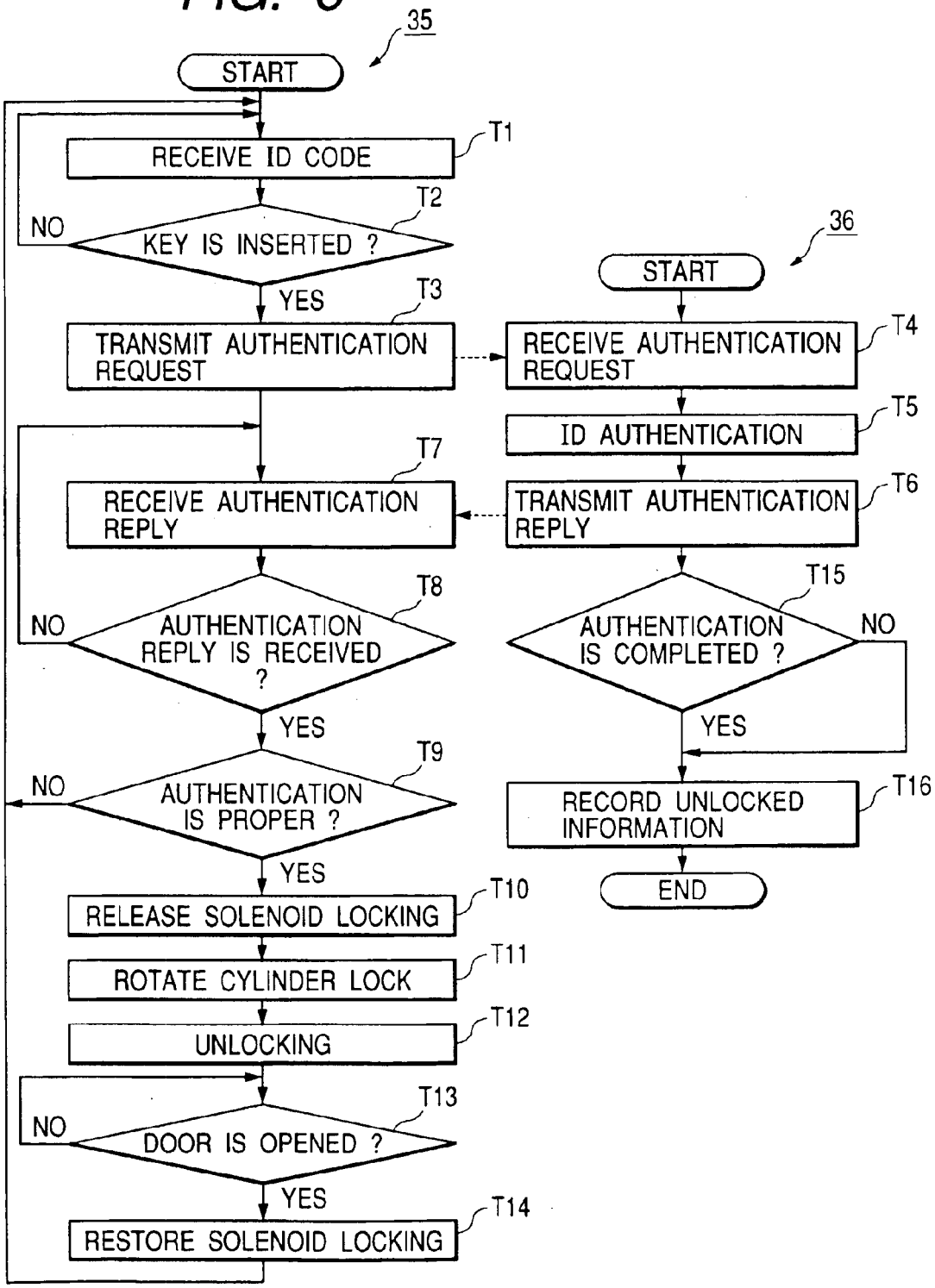
FIG. 6 is a flowchart showing unlocking operation performed when a stand-alone system is caused to operate as a terminal of a network.

There will now be described, by reference to a flowchart shown in FIG. 6, unlocking operation to be performed when the stand-alone system is caused to serve as a terminal of a network. Through use of the manager 36, the network system effects an authorizing function which has been performed by individual terminals in the stand-alone system. The terminal number provider 35*a* serving as a terminal and the antenna section 31*a* provided in the stand-alone system 30 having the LAN controller 35*b* remain in a standby state while remaining ready to receive. When the antenna section 31*a* receives the ID code transmitted from the key by radio communication (step T1), a determination is made as to whether or not the key has been inserted (step T2). If the key is not inserted, the determination to be performed in step T2 is iterated. If the key is inserted, an ID authentication request signal is transmitted to the manager 36 (step T3).

Upon receipt of the ID authentication request signal (step T4), the manager 36 authenticates an ID (step T5). The manager 36 sends a result of authentication to the stand-alone system 30 as an authentication reply signal (step T6). The stand-alone system 30 determines whether or not the authentication reply signal has been received (steps T7, T8). If the signal has not been received, processing proceeds to step T7. In contrast, if the authentication reply signal has been received, a determination is made as to whether or not the ID code is authenticated (step T9). If a result of the determination shows that the ID is not authenticated (step T10), processing returns to step T1. If the ID code is authenticated, the solenoid is released (step T10). As a result, actuation of the inserted key becomes possible. When the key is turned (step T11), the locker provided on the gaming machine is unlocked (step T12). Next, a determination is made as to whether or not the door of the gaming machine has been opened (step T13). If the door has not been opened, the determination to be performed in step T13 is iterated. In contrast, if the door has been opened, the solenoid is restored to its original position (step T14).

A key operation history is saved (step T16), regardless of whether the ID code is authenticated or not after the authentication reply signal has been transmitted in step T6 (step T15), and processing is terminated.

In this case, in addition to the above described advantages, since the ID code of the key can be checked against the registered ID code by way of a communication network centralized control of locking and unlocking operations is enabled. Further, the ID code representing the owner of the key (corresponding to an ID unique to a house ID and an individual ID shown in FIG. 7) and the date of unlocking operation read from the real time clock 36*h* are saved as a key operation history. Hence, the usage condition of the key can be ascertained, thereby facilitating identification of a person who has used the key. As a result, security is improved.

In this system, the key ID writer 36*i* is provided in the manager 36. Hence, rewriting of IDs is considered to be performed almost on a day-to-day basis. Specifically, individual IDs of the keys and the manager are rewritten to new IDs at one time, through use of the key ID writer 36*i* before opening of a casino or the like, and the keys are delivered to employees.

Update of ID codes is now described by reference to FIG. 7 showing ID codes allocated to respective keys "a" to "e." Each of the ID codes is constituted of a fixed code and a variable code. The fixed code is formed from an ID code which is unique to a house (casino or the like) and common to all keys (hereinafter called a "house ID"), and an individual ID code. The variable code is constituted of an authentication ID code. For instance, in the case of a key "a," the house ID is "253" and an individual ID is "124." The variable authentication ID is a variable number extracted by a random number generator. In FIG. 7, the uppermost value of the authentication ID assigned to the key "a" is "5548," and the second uppermost value of the authentication ID is "23." In this way, the final four digits of the ID code are changed.

In this embodiment, the ID code is updated each time an unlocking operation is performed. In this way, so long as the ID code is rewritten each time unlocking operation is performed, unauthorized analysis of an ID code becomes difficult. Even if an ID code has been analyzed, the ID code will be again changed randomly. Hence, a security level can be improved considerably. Accordingly, a required network system is determined according to whether ID codes are to be rewritten on a day-to-day basis or ID codes are to be rewritten each time an unlocking operation is performed, in order to increase a security level.

Figure 8:
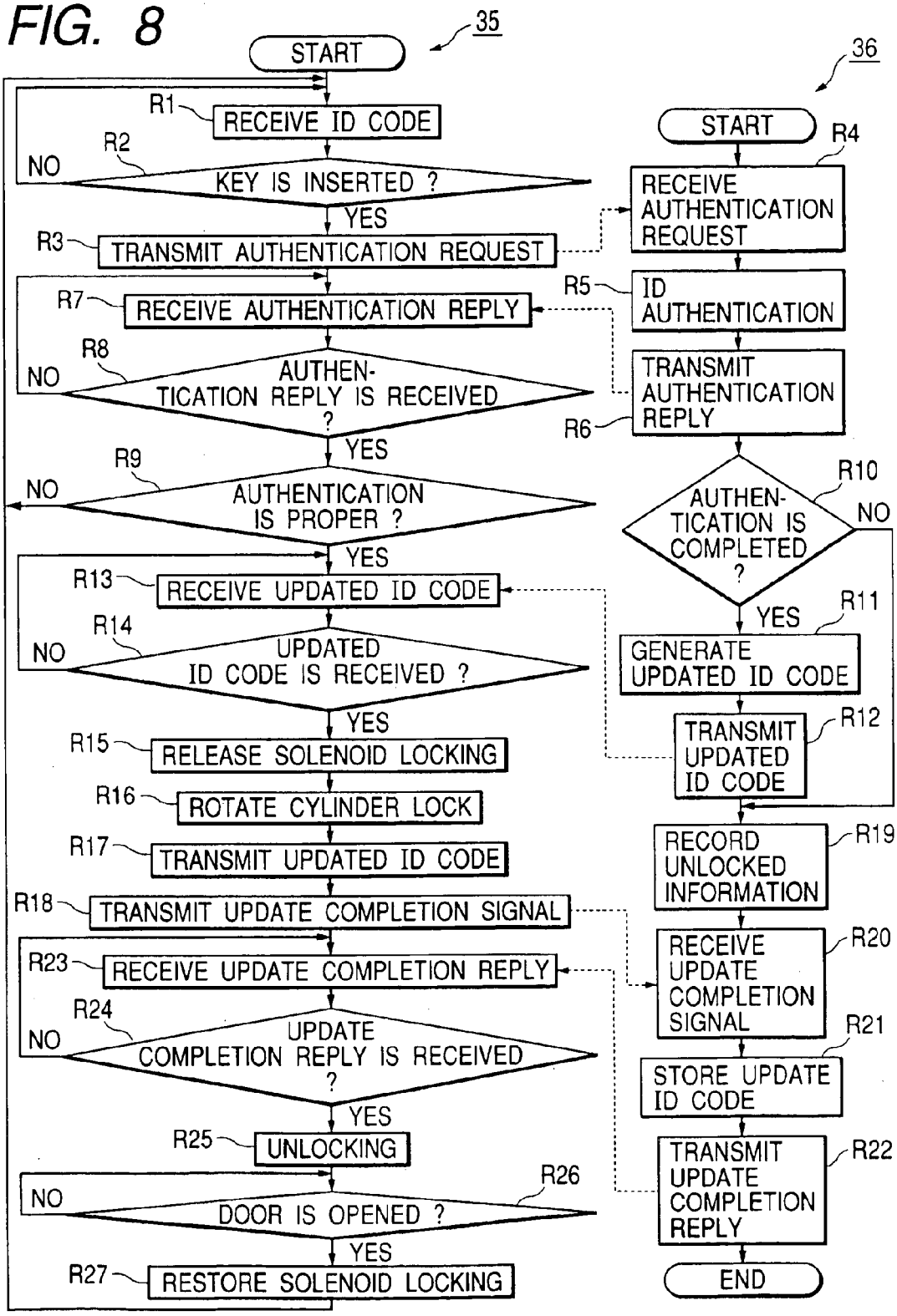
FIG. 8 is a flowchart showing unlocking operation of the network system.

Unlocking operation of the network system will now be described by reference to a flowchart shown in FIG. 8. The network system enables each of terminals 35 to rewrite an authentication code, while enabling the manager 36 to perform authorizing function performed by individual terminal devices. The antenna section 35*c* disposed in the terminal device 35 remains in a standby state whereby it is ready to receive at all times. When the ID code has been transmitted by the antenna section 35*c* by radio communication (step R1), a determination is made as to whether or not the key 37 has been inserted (step R2). If the key 37 has not been inserted, an ID authentication request signal is transmitted to the manager 36 (step R3).

Upon receipt of the ID authentication request signal (step R4), the manager 36 authenticates an ID (step R5). The manager 36 transmits the result of authentication to the terminal gaming machine 35 as an authentication reply signal (step R6). The terminal gaming machine 35 determines whether or not the authentication reply signal has been received (steps R7, R8). If the signal has not yet been received, processing returns to step R7. In contrast, if the signal has been received, a determination is made as to whether or not the ID code is authenticated (step R9). If a result of determination shows that the ID code is not authenticated, processing proceeds to step R1.

The manager 36 that has transmitted the authentication reply signal in step R6 determines whether or not the ID code is authenticated (step R10). If the ID code is not authenticated, processing proceeds to step R19. In contrast, if the ID code is authenticated, an updated ID code is generated (step R11).

The updated ID code generated in step R11 is transmitted to the terminal gaming machine 35 (step R12). The terminal gaming machine 35 determines whether or not the updated ID code has been received from the manager 36 (steps R13, R14). If the code has not been received, processing returns to step R13. In contrast, if the updated ID code has been received, the solenoid is released (step R15). As a result, actuation of an inserted key becomes possible. When the key is turned (step R16), an updated ID code is transmitted from the terminal gaming machine 35 to the key 37 by radio communication (step R17). Here, the received updated ID code may be written into the ID chip 37*a* of the key 37, and a signal indicating successful update sent to the terminal gaming machine 35.

Next, when update of the ID code has been completed, the terminal gaming machine 35 transmits an update completion signal to the manager 36 (step R18). The manager 36 saves a history about actuation of the key 37 (step R19). Upon receipt of an update completion signal from the terminal device 35 (step R20), the manager 36 saves an updated ID code (step R21). Moreover, an update completion reply signal indicating that this signal is an reply to the update completion signal is transmitted to the terminal gaming machine 35 (step R22), thereby terminating processing.

The terminal gaming machine 35 determines whether or not the update completion reply signal has been received (steps R23, R24). If the signal has not been received, processing returns to step R23. In contrast, if the signal has been received, the locker provided on the gaming machine is released (step R25). Next, a determination is made as to whether or not a door of the gaming machine has been opened (step R26). If opening of the door has failed, the determination to be made in step R26 is iterated. If the door has been opened, the solenoid is restored to its original position (step R27).

In this case, in addition to the above-described advantages, since an updated ID code is generated, and the thus-generated ID code is rewritten over the ID code of the key and the registration ID code, the latest information can be used at all times. Even when information is acquired before rewriting, performing unauthorized unlocking operation becomes considerably difficult. As mentioned above, an ID code is rewritten each time an unlocking operation is performed, thereby making unauthorized analysis of an ID code difficult. Even if an ID code has been analyzed, the ID code is changed randomly each time unlocking operation is performed. Hence, a security level can be enhanced considerably.

Figure 9:
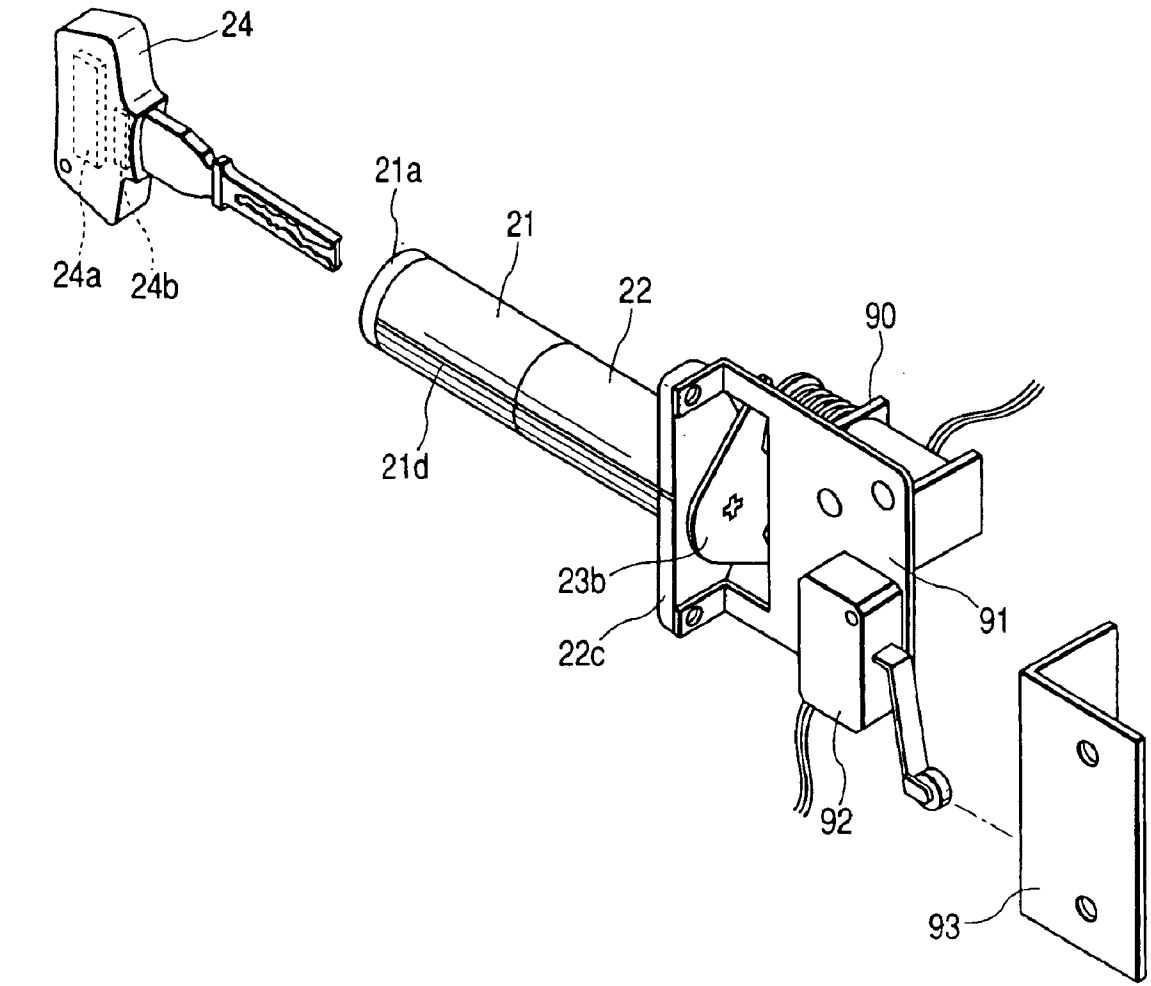
FIG. 9 is a view showing a mechanical configuration of a cylinder lock unit of a second embodiment.
Figure 10:
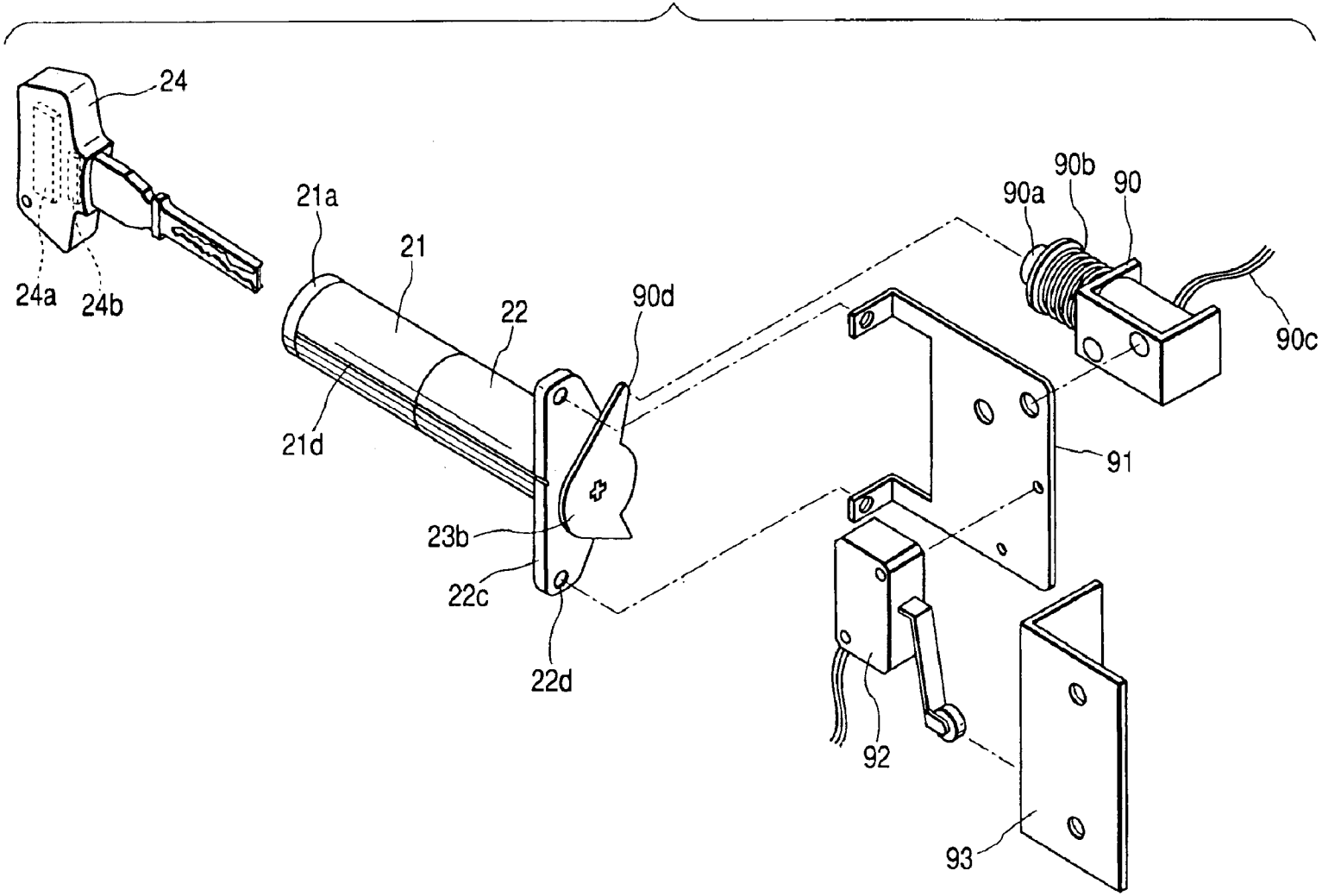
FIG. 10 is a fragmentary exploded view of the cylinder lock unit of the second embodiment.
Figure 11:
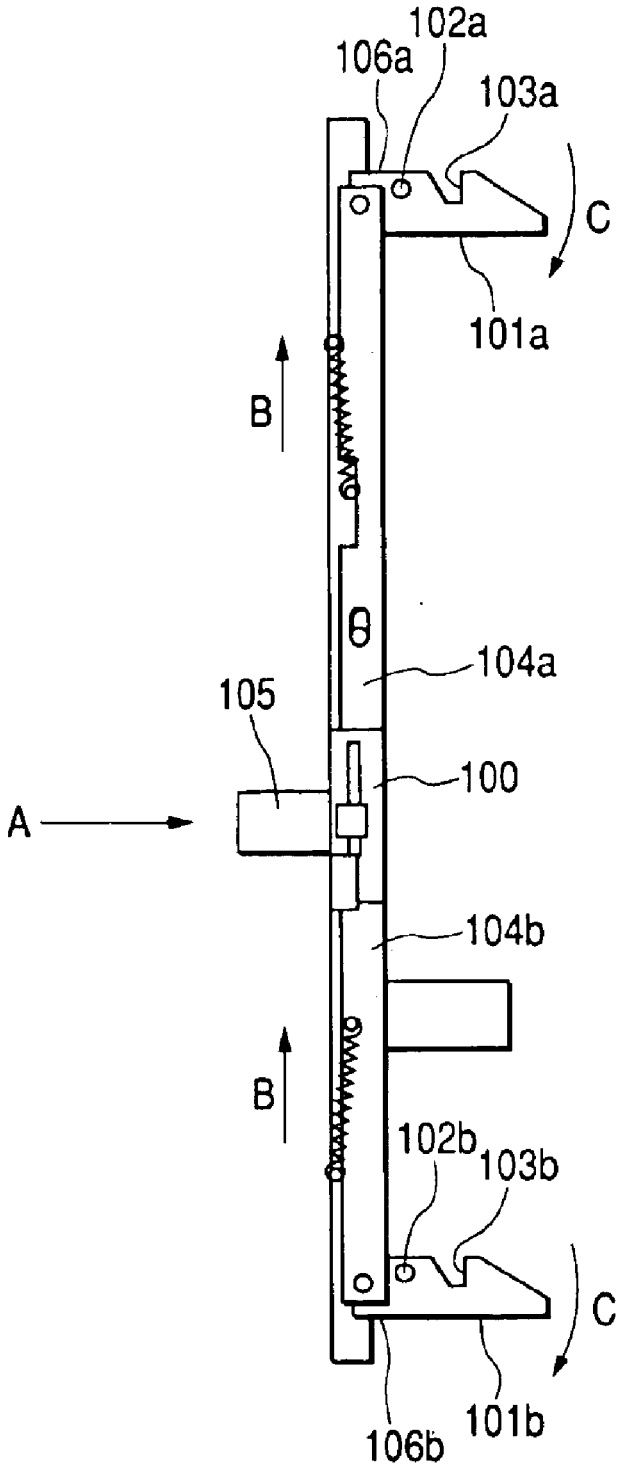
FIG. 11 is a view showing the configuration of a related-art mechanical locker.

FIG. 9 is a view showing a mechanical configuration of a cylinder lock unit according to a second embodiment of the invention. FIG. 10 is a fragmentary exploded view of the cylinder lock unit of the second embodiment. In the second embodiment, a solenoid serving as a limiter is provided at the outside of the adjuster 22. A solenoid 90 has a projection 90*a* which can advance or recede, a coil 90*b* which forces the projection 90*a* toward the contact plate 23*b*, and a lead wire 90*c* for supplying power.

The contact plate 23*b* rotates in association with rotation of the cylinder 21. The projection 90*a* of the solenoid 90 comes into contact with a side face 90*d* of the contact plate 23*b* so as to hinder rotation of the contact plate 23*b*. As a result, the contact plate 23*b* cannot rotate clockwise with reference to the paper of FIG. 9 or 10. Accordingly, the key 24 cannot be turned counterclockwise with reference to the direction of insertion of the key 24 unless an ID code is authorized. The solenoid 90 and the flange 22*c* are fixed to a fixing plate 91 by, e.g., screws. A micro-switch 92 operates as a door switch for sensing opening and closing actions of the door. A contact member 93 is brought into contact with a lever of the micro-switch 92. While the door is closed, the lever of the micro-switch is pressed, to thereby become operative. In this state, the micro-switch is attached with screws or the like.

The ID code received from the key 24 is authenticated. If the ID code matches the registered ID code, a voltage is applied to the solenoid 90, whereby the projection 90*a* is receded. As a result, the projection 90*a* does not come into contact with the contact plate 23*b*. Hence, the key 24 can be turned counterclockwise with reference to the direction of insertion of the key 24.

As mentioned, only when the projection 90*a* that can advance and recede remains in contact with the contact plate 23*b* and when a match exists between the ID code and the registered ID code, the projection 90*a* is receded. As a result, a structure for restricting actuation of the key 24 is simplified, thereby curtailing costs. Further, if the ID code does not match the registered ID code, the projection 90*a* does not recede, thereby eliminating a chance of unauthorized unlocking operation.

When the projection 90*a* is brought into contact with the side face 90*d* of the contact plate 23*b*, the contact plate 23*b* cannot rotate clockwise in FIG. 9 or 10 but can rotate counterclockwise. Accordingly, so long as the key 24 mechanically matches the cylinder 21, regardless of authentication of an ID code, the key 24 can be turned clockwise with reference to the direction of insertion of the key 24. Therefore, if clockwise turning of the key 24 is associated with actuation of a reset switch, a simple trouble may be addressed by resetting operation.

The second embodiment has illustrated an embodiment in which the projection 90*a* is brought into contact with the side face 90*a* of the contact plate 23*b*. There may also be employed a structure in which a joint hole into which the projection 90*e* is joined may be formed in the contact plate 23*b*, and in which the projection 90*a* is fitted into the hole in a standby state. In this case, the projection 90*a* fits into the hole, and hence, the key 24 can be turned neither clockwise nor counterclockwise when in a standby state. Only when a match exists between the ID code acquired from the key 24 and the registered ID code, the projection 90*a* is receded.

In this way, only when the projection 90*a* that can advance or recede is engaged with the hole formed in the contact plate 213*b* and when a match exists between the ID code and the registered ID code, the projection 90*a* is receded, thereby simplifying the structure for restricting actuation of the key 24 and curtailing costs. If no match exists between the ID code and the registered ID code, the projection 90*a* will not be receded, thereby eliminating a chance of occurrence of unauthorized unlocking operation.

What is claimed is:

1. A locking device operable with a key provided with identification information, the locking device comprising:

a lock section, mechanically actuated by the key to perform a locking or unlocking operation;

a receiver, which acquires the identification information from the key;

a checker, which determines whether the identification information acquired by the receiver matches with pre-stored registration information of the key; and a limiter, which restricts the unlocking actuation of the lock section when the checker determines that the identification information does not match with the registration information, wherein:

the lock section is formed with a hole;

the limiter has a protrusion axially movable between a first position which is inside of the hole and a second position which is outside of the hole; and the protrusion is placed at the first position when the checker determines that the identification information does not match with the registration information.

2. The locking device as set forth in claim 1, wherein:

the receiver includes an antenna which performs radio wave communication; and the lock section includes a guide member which guides a wiring for the antenna.

3. The locking device as set forth in claim 2, wherein the identification information is communicated via the radio wave communication.

4. The locking device as set forth in claim 1, further comprising a storage, which stores unlocked information when the restriction of the unlocking actuation of the limiter is released.

5. The locking device as set forth in claim 1, wherein the lock section comprises a cylinder, and at least on e of said protrusion and said hole is disposed within said cylinder.

6. A locking device operable with a key provided with identification information, the locking device comprising:

a lock section, mechanically actuated by the key to perform a locking or unlocking operation;

a receiver, which acquires the identification information from the key;

a checker, which determines whether the identification information acquired by the receiver matches with pre-stored registration information of the key; and a limiter, which restricts the unlocking actuation of the lock section when the checker determines that the identification information does not match with the registration information, further comprising an adjuster connected to the lock section to adjust an entire axial length of the locking device in accordance with a length of the key, the adjuster accommodates the limiter therein.

7. The locking device as set forth in claim 6, wherein the lock section comprises cylinder and a contact plate external thereto, and said protrusion is operable to engage said contact plate.

8. The locking device as set forth in claim 6, wherein the adjuster is exchangeably connected to the lock section to adjust the entire axial length of the locking device.

9. A locking device operable with a key provided with identification information, the locking device comprising:

a lock section, mechanically actuated by the key to perform a locking or unlocking operation;

a receiver, which acquires the identification information from the key;

a checker, which determines whether the identification information acquired by the receiver matches with pre-stored registration information of the key; and a limiter, which restricts the unlocking actuation of the lock section when the checker determines that the identification information does not match with the registration information, further comprising an actuator interlocked with the locking or unlocking operation of the lock section, wherein:

the limiter has a protrusion movable axially between a first position which disables the actuator to move and a second position which enables the actuator to move; and the protrusion is placed at the first position when the checker determines that the identification information does not match with the registration information.

10. A locking device operable with a key provided with identification information, the locking device comprising:

a lock section, mechanically actuated by the key to perform a locking or unlocking operation;

a receiver, which acquires the identification information from the key;

a checker, which determines whether the identification information acquired by the receiver matches with pre-stored registration information of the key; and a limiter, which restricts the unlocking actuation of the lock section when the checker determines that the identification information does not match with the registration information, further comprising an actuator interlocked with the locking or unlocking operation of the lock section, wherein:

the actuator is formed with a hole;

the limiter has a protrusion movable axially between a first position which is inside of the hole and a second position which is outside of the hole; and the protrusion is placed at the first position when the checker determines that the identification information does not match with the registration information.

* * * * *